US006312181B1

(12) United States Patent
Joulia

(10) Patent No.: US 6,312,181 B1
(45) Date of Patent: Nov. 6, 2001

(54) DISPOSABLE MAKE-UP APPLICATOR

(75) Inventor: Gérard Joulia, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/358,254

(22) Filed: Jul. 20, 1999

(30) Foreign Application Priority Data

Jul. 20, 1998 (FR) ..... 98 09225

(51) Int. Cl.[7] ..... B05C 21/00

(52) U.S. Cl. ..... 401/196; 4/200; 4/25; 132/317; 15/104.94

(58) Field of Search ..... 401/196, 200, 401/132, 133, 136, 139, 23, 25, 6, 49, 261, 266, 192; 132/317, 318, 320, 307; 15/104.94; 206/484; 604/304, 289

(56) References Cited

U.S. PATENT DOCUMENTS

| | | | | |
|---|---|---|---|---|
| 1,743,512 | | 1/1930 | Aisen . | |
| 1,836,833 | | 12/1931 | Ames . | |
| 1,888,314 | | 11/1932 | Framke . | |
| 2,082,255 | * | 1/1937 | Murea | 132/307 |
| 2,775,246 | | 12/1956 | Morrell . | |
| 5,161,688 | * | 11/1992 | Muchin | 206/484 |
| 5,830,485 | | 3/1998 | Gueret et al. . | |
| 5,861,165 | * | 1/1999 | Joulia | 424/401 |
| 6,062,234 | * | 5/2000 | Finocchiaro et al. | 132/320 |

FOREIGN PATENT DOCUMENTS

| | | |
|---|---|---|
| 0 197 184 A2 | 10/1986 | (EP) . |
| 0 441 667 A2 | 8/1991 | (EP) . |
| 0 700 646 A1 | 3/1996 | (EP) . |
| 0 722 676 A1 | 7/1996 | (EP) . |
| 2 703 587 | 10/1994 | (FR) . |
| 51-18072 | 5/1976 | (JP) . |
| 63-139110 | 6/1988 | (JP) . |
| 6-305936A | 11/1994 | (JP) . |
| 9-187316 | 7/1997 | (JP) . |

* cited by examiner

*Primary Examiner*—Gregory L. Huson
*Assistant Examiner*—Huyen Le
(74) *Attorney, Agent, or Firm*—Oblon, Spivak, McClelland, Maier & Neustadt, P.C.

(57) ABSTRACT

A disposable make-up applicator comprising at least one layer of a porous, flexible material, where at least one part of a first face is impregnated with at least one slakable make-up product, and having a second face, opposite the first, which is covered with an impermeable film. The first face has at least one peripheral portion zone, which is not impregnated with the make-up product, and serves as a zone for gripping the applicator and/or a zone for shading off the product when applied by the user.

26 Claims, 2 Drawing Sheets

DISPOSABLE MAKE-UP APPLICATOR

BACKGROUND OF THE INVENTION

1. Field of the Invention

The present invention relates to an applicator, of the make-up applicator type, particularly a single-dose applicator, which the user may throw away after use. Generally, this applicator is in the form of a flat support formed by a flexible sheet made from a porous, absorbent material on which a thin layer of a slakable make-up product is deposited. Among the make-up products that may be used within the scope of the invention, examples foundations, eyeshadows, rouges, blushers and similar products.

2. Description of the Background

A make-up powder sample is known, presented in the form of an advertising support for a range of shades. This support comprises a rigid cardboard sheet on which several zones are covered with a fine layer of make-up powder in different colors, which the user may sample, for example with her finger, in order to apply the powder of the desired tint to her face, by transfer. This method of applying make-up has the disadvantage that the user's fingers are frequently soiled and have to be cleaned after application. Moreover, it is difficult to obtain homogeneous spreading of the powder using one's fingers, particularly when a relatively large area has to be made up, which is the case, in particular, when the product is a foundation.

U.S. Pat. No. 1,836,833 describes an applicator which may be disposed after use, consisting of a flat member of which a first face is impregnated with product, a second face, arranged on the back, including a layer which is impermeable to the product, protecting the user's fingers against soiling by the product. However, this arrangement does not provide protection for the fingers when they come into contact with the first face which is impregnated with product.

SUMMARY OF THE INVENTION

It is thus one of the objects of the present invention to provide an applicator, of the make-up applicator type, which does not have the disadvantages described above.

It is another object of the invention to provide an applicator which is disposable, which is advantageous both economically and ecologically.

It is another object of the invention to provide an applicator which avoids soiling of the user's fingers by the product during application.

The objects of the present invention, and others, may be accomplished with an applicator, particularly a disposable make-up applicator, including at least one layer of a porous, flexible material, of which at least one part of a first face is impregnated with at least one slakable make-up product, a second face, opposite the first, being covered with an impermeable film. According to the invention, the first face has at least one peripheral portion zone, which is not impregnated with the make-up product, serving as a zone for gripping the applicator and/or a zone for shading off the product applied by the user.

The applicator according to the invention is intended to be transported in the user's handbag or packaged in an individual protective sachet of small volume and may be used to refresh make-up during the day, particularly when travelling. According to another aspect of the invention, a range of applicators of different shades may be used as a tester which the user tries out at the point of sale before deciding to select one or other shade of make-up product packaged in multi-dose form.

On account of its small thickness, an applicator of this type may also be inserted, as a sample, into the advertising pages of women's publications.

According to yet another aspect of the invention, a plurality of applicators according to the invention may be packaged in an appropriate dispensing device to be placed on the user's make-up table.

The applicator of the present invention may be manufactured industrially at a very advantageous cost. It may thus be produced on a conventional printing machine, for example by means of screen process printing. The applicator of the invention offers the advantage that it can be manufactured from biodegradable materials and, from this standpoint, is of significant ecological interest.

A more complete appreciation of the invention and many of the attendant advantages thereof will be readily obtained as the same becomes better understood by reference to the following detailed description, in conjunction with the Figures described below.

DETAILED DESCRIPTION OF THE INVENTION

Figure 1:
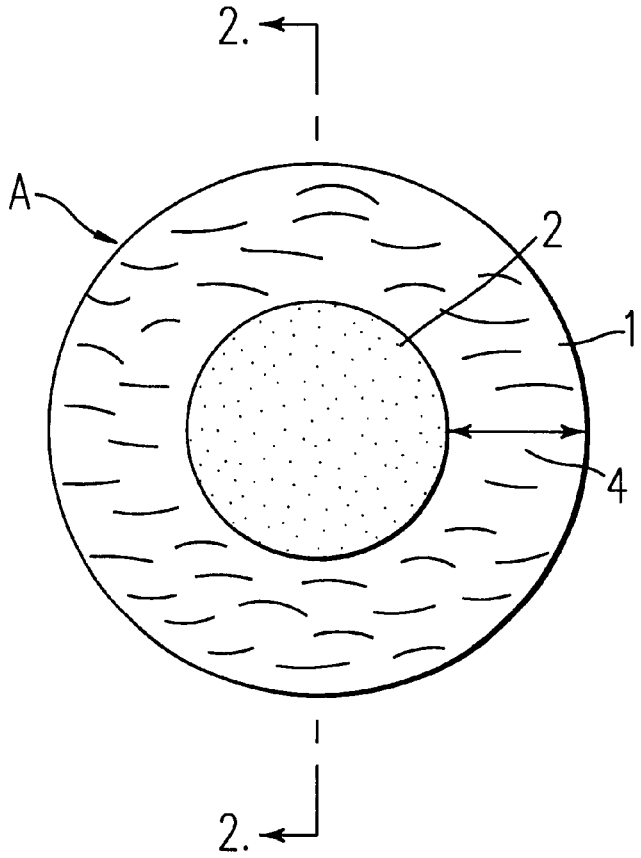
FIG. 1 shows a plan view of an applicator according to a first embodiment of the invention.

In one embodiment, the applicator is preferably of the single-dose type.

The impermeable film is provided in order to prevent penetration of the make-up product onto the non-impregnated face of the applicator, which could soil the user's fingers during application of the make-up. In a preferred embodiment, the film is thin and flexible. The impermeable film preferably comprises an appropriate plastic, particularly a thermoplastic material, such as a polyethylene film, where the thickness is preferably between 10 $\mu$m and 50 $\mu$m (the endpoints described herein are included unless specified otherwise). In order to confer non-slip properties on the external surface of the film, i.e., the face that is not in contact with the second face of the layer comprising the porous, flexible material, it may previously have undergone an appropriate treatment, for example a corona treatment. The film is advantageously deposited on the layer made from porous material by means of heat welding, or any other appropriate means.

The make-up product is advantageously deposited substantially at the center of the applicator. In this way, the peripheral portion which is not impregnated with product forms a continuous annular edge which entirely surrounds the part which is impregnated with product. During making up, this edge serves as a gripping zone for the user: in order to use the applicator of the invention, generally, the user may take the applicator between her thumb and forefinger and/or middle finger, placing the thumb on the gripping zone of the second face and her forefinger and/or middle finger on the impermeable film.

Another portion of this annular edge may serve, if appropriate, for spreading and shading off the product applied to the skin. This arrangement makes it possible to keep the fingers clean throughout the make-up operation.

Naturally, the portion which is not impregnated with the product may form a gripping zone and a shading-off zone which are separate from one another and, optionally, discontinuous. In this embodiment, the gripping and shading-off zones may be located on substantially opposite ends of the applicator.

According to a preferred embodiment, the applicator is in the form of a flat circular or oval disc and has a total thickness of between 5/100 mm and 5/10 mm (endpoints included). This range for the thickness includes all specific values and subranges therebetween, such as 1/10, 1/5, 1/4, 3/10, 4/10 and 45/100 mm. Its surface area is preferably between 25 $cm^2$ and 200 $cm^2$ (endpoints included). This range for the surface area includes all specific values and subranges therebetween, such as 30, 50, 75, 100, 125, 150 and 175 $cm^2$.

The preferred material preferably comprises a nonwoven. Alternatively, it may be a woven material or an open-cell foam.

Generally, the make-up products used in the applicator are substantially solid products. Examples of such products include, for example, pigments, binders, fillers, oils and perfumes.

According to a preferred embodiment, the fillers/binders contain hydrated plaster, talc particles, polyamide particles, rice powder, expanded microspheres, hollow shapes made from thermoplastic material, etc.

The make-up product's shade is obtained by using colored pigments therein, for example oxides of iron, of chromium, of titanium or mica.

Thus, all conceivable shades may be produced. It is also possible to juxtapose several products of different colors on one and the same applicator. In this case, interesting graphic designs may be obtained.

In the case of a porous material comprising a nonwoven, it advantageously has a weight of between 20 $g/m^2$ and 80 $g/m^2$, and, more particularly, weighs approximately 40 $g/m^2$. This weight includes all specific values and subranges therebetween, such as 25, 30, 35, 50, 60 and 70 $g/m^2$. This nonwoven material is preferably chosen from nonwovens with a water-absorption capacity of between 500% and 2500%, inclusive of all specific values and subranges therebetween such as 600%, 750%, 1000%, 1500% and 2000%.

Generally, a nonwoven material of this type is obtained by mechanical, chemical or thermal binding of textile filaments or fibers arranged in plies.

According to a preferred embodiment of the invention, these fibers comprise a mixture of fibers of cellulose (viscose) and of polyester. Advantageously, the proportion of fibers of cellulose/fibers of polyester is approximately 67/33.

In the case of a woven material, use is advantageously made of a cotton or a nylon. By way of example of an open-cell foam, use may be made of a polyether or polyurethane foam.

The invention also relates to a process for manufacturing an applicator as defined above, by:

(a) preparing a make-up composition of liquid to pasty consistency;

(b) depositing, by means of screen process printing or pouring, a specific quantity of the composition onto a flexible sheet made from porous material;

(c) drying the sheet impregnated with the composition for a specific period; and (d) cutting the sheet around the impregnated zones according to the desired shape in order to obtain the applicator, so as to form at least one non-impregnated portion at the periphery of the applicator.

The make-up composition is preferably formed from an aqueous dispersion of a binder and at least one type of pigment. In this case, the binder preferably comprises plaster.

In order to manufacture the applicator of the invention, use is advantageously made of a composite sheet consisting of a layer of nonwoven such as defined above, previously covered on one of its faces with a thermoplastic film. By way of example, mention will be made of the product REANOT 40+20PE®, marketed by Reanot.

According to a preferred manufacturing method, circular patches are printed onto a composite sheet of this type, uniformly spaced, using a screen process printing machine. Thus, the product is fixed in a thin layer, using only a few mg of product. The patches are obtained from a liquid to pasty composition containing a suspension of pigments in an aqueous medium to which, if appropriate, binders and/or fillers have been added. Generally, a suspension of this type has the form of a paste which is capable of flowing through the effect of its own weight and capable of solidifying after impregnating the nonwoven layer.

According to a particularly preferred embodiment, the binder/filler used is plaster ($CaSO_4 \times ½ H_2O$). In this case, printing must be completed before the plaster sets. To this end, the composition may contain plaster-setting retardants. Other fillers may consist of powders of rice, polyamide (nylon), oxides of titanium or titanium, etc. The binder may also consist of waxes or oils, which may be volatile or non-volatile.

It is also possible to deposit the suspended composition by means of another transfer process, for example by simple pouring, spreading or calendering.

After solidification, at the end of a specific period, the applicators are cut into the desired shape and may be packaged in an appropriate packaging. To this end, it is possible to provide individual sachets, for example produced from a transparent sheet in order to display the make-up product. It is also possible to combine a whole range of applicators of different shades and to present this set in the form of make-up tester palettes in a display unit at the point of sale.

According to a variant embodiment, it is possible to employ make-up products which liquefy at high temperature and solidify after cooling. It is also possible to envisage depositing, by pouring or by transfer, a dispersion of pigments in a solvent, solidification of the product being obtained by evaporation of the solvent.

The applicator which has just been described can be used, in particular, for direct application to the skin of a rouge, foundation, eyeshadow, etc.

To describe the invention in even greater detail, a description thereof will now be provided, by way of purely illustrative and non-limiting examples, of two embodiments of the applicator according to the invention as shown in the Figures.

Figure 2:
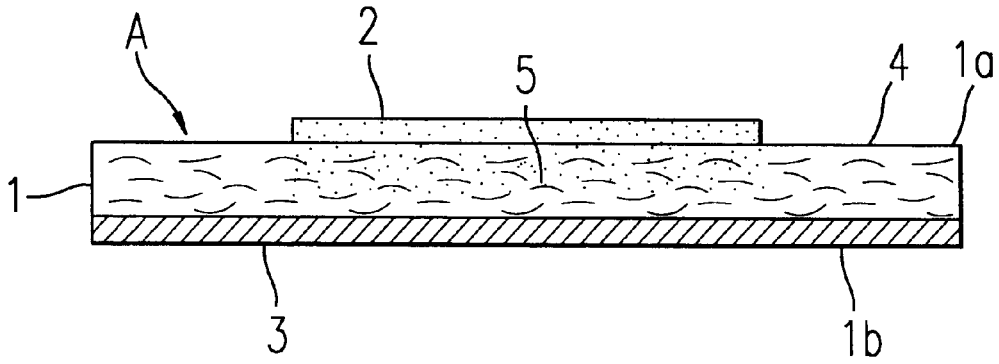
FIG. 2 shows an enlarged view in transverse section along the line II—II of FIG. 1.

In FIGS. 1 and 2, an applicator denoted overall by the reference A has the form of a circular disc. This applicator has a diameter of approximately 50 mm. It comprises a layer 1 made from a nonwoven material, constituting a product support, the thickness of which is approximately 0.2 mm. This nonwoven material is composed of a mixture of 67% viscose fibers and 33% polyester fibers. The lower face 1*b* of the layer 1 is covered with a polyethylene film 3 with a thickness of approximately 25 $\mu$m. The upper face 1*a* of the layer 1 is impregnated with a slakable product 2 arranged substantially at the center of the applicator. It is to be noted that the product has partially diffused into the layer 1 (see ref. 5 in FIG. 2), thus ensuring its attachment to the layer 1. The product to be applied is in the form of a circular patch with a diameter of approximately 35 mm. Thus, an annular edge 4 is formed via which the applicator may be gripped, without soiling the fingers with product.

An edge portion 4 thus serves as a gripping zone, another zone of this edge serving as a zone for spreading and shading off the product applied to the skin.

Having generally described this invention, a further understanding can be obtained by reference to certain specific examples which are provided herein for purposes of illustration only and are not intended to be limiting unless otherwise specified.

EXAMPLES

Example 1

Production of a Rouge

A pulverulent mixture with the following formulation is prepared:

| | |
|---|---|
| Plaster ($CaSO_4$, ½ $H_2O$) | 250 g |
| Talc | 250 g |
| Lauroyllysine-coated talc | 100 g |
| Hollow microspheres marketed as "EXPANCEL 550 DE" by KEMANORD PLAST | 50 g |
| mica powder | 240 g |
| Calcium carbonate | 50 g |
| Titanium dioxide | 20 g |
| Red iron oxide | 35 g |
| Black iron oxide | 5 g |
| as is an aqueous phase having the following composition: | |
| Surfactant marketed as "Glucoquat 100" by AMERCHOL | 45 g |
| Preservative | 1 g |
| Water | 1200 g |

The pulverulent phase and the aqueous phase are mixed for 5 minutes in a mixer equipped with a slow agitation device. A pourable paste is obtained, which has to be used before it sets. Setting occurs after approximately 30 minutes.

The paste thus obtained is loaded into the feeder of a screen process printing machine. A sheet in the form of a complex including a layer of nonwoven covered with a polyethylene film is introduced into this machine. This sheet is marketed as "REANOT 40+20PE" by Reanot. This printing machine is used to print, by screen process printing, circular patches 2 consisting of a thin layer of the paste. The diameter of these patches is advantageously chosen as a function of the type of making up to be carried out. Thus, an applicator intended for making up the eyelids has a patch with a diameter of approximately 15 mm to 25 mm; a patch consisting of a foundation or a rouge may have a diameter of approximately 35 mm to 60 mm.

After printing, the complex-type sheet is allowed to rest for 30 minutes until the product has completely dried. Applicators A are then cut out so that the product patch 2 is surrounded by a free annular edge 4 of approximately 8 mm.

Each applicator thus obtained is inserted into a transparent sachet, which sachet is then closed, for example by means of heat sealing.

In order to make up her cheeks, the user takes the applicator A out of its packaging, taking care to grip it only by means of its free edge 4, between the thumb and index finger, the face including the film 3 facing the index finger. The other face printed with make-up product 2 is then applied to the cheek where, by means of light circular rubbing, the powder is deposited. Depending on the pressure applied, greater or lesser slaking may be obtained. By using the free edge 4 of the applicator, shading off and homogeneous spreading of the product may be obtained on the cheek.

Figure 3:
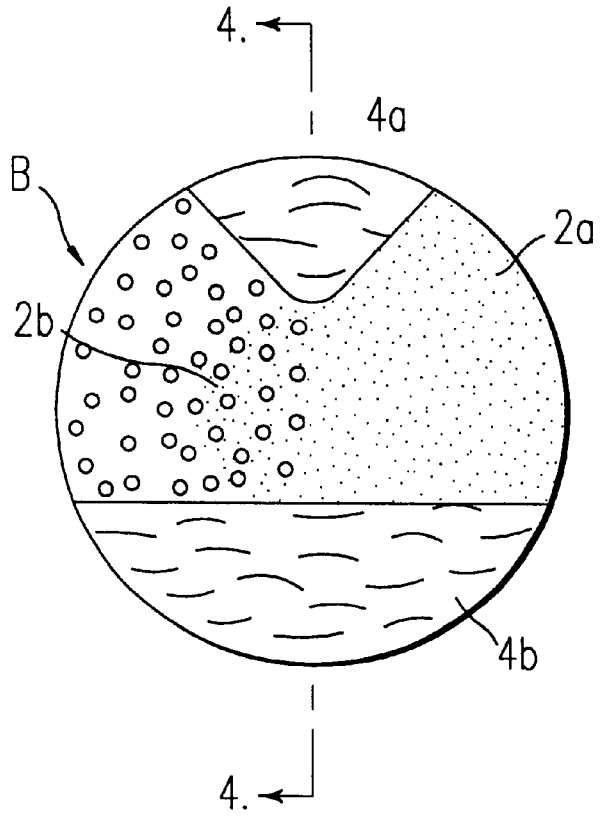
FIG. 3 shows a plan view of an applicator according to a second embodiment of the invention.
Figure 4:
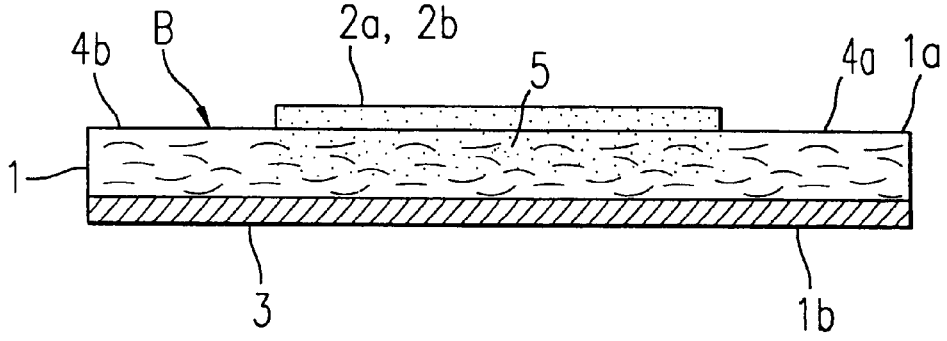
FIG. 4 shows an enlarged view in transverse section along the line IV—IV of FIG. 3.

FIGS. 3 and 4 show another embodiment of an applicator B, in which part of the porous layer 1 is covered with two different products 2*a*, 2*b* juxtaposed on its upper face 1*a*. The lower face 1*b* is covered, in a manner similar to the first embodiment, with an impermeable film 3. The upper face includes a gripping zone 4*a*, located on the periphery of the applicator B, the size of which zone is adapted to the placing of the user's thumb. A zone 4*b*, substantially diametrically opposed to the gripping zone 4*a*, is intended to serve as a zone for spreading and/or a zone for shading off the product applied to the skin. The zones 4*a* and 4*b* which are not impregnated with product may be configured in any form which is appropriate to ergonomic making up.

Obviously, numerous modifications and variations of the present invention are possible in light of the above teachings. It is therefore to be understood that within the scope of the appended claims, the invention may be practiced otherwise than as specifically described herein.

This application is based on French Application Ser. No. 98-09225, filed on Jul. 20, 1998, and incorporated herein by reference in its entirety.

What is claimed is:

1. A disposable make-up applicator, comprising:

at least one layer comprising a porous, flexible material having a first face and a second face, wherein at least a portion of the first face is impregnated with at least one slakable make-up product, the second face, opposite the first face, is covered with an impermeable film, the first face comprises at least one non-adhesive peripheral portion zone which is not impregnated with the slakable make-up product.

2. The applicator of claim 1, wherein the make-up product has been deposited on the porous material by screen process printing.

3. The applicator according to claim 1, wherein the make-up product has been deposited on the porous material by pouring.

4. The applicator of claim 1, which has a total thickness of between 1/100 mm and 5/10 mm.

5. The applicator of claim 1, wherein the porous material comprises a nonwoven material, a woven material, or an open-cell foam.

6. The applicator of claim 1, wherein the make-up product is a foundation, a rouge or an eyeshadow.

7. The applicator of claim 1, wherein the make-up product comprises zones of different colors.

8. The applicator of claim 1, wherein the make-up product comprises pigments, binders, fillers, oils or perfumes.

9. The applicator of claim 1, wherein the make-up product comprises hydrated plaster.

10. The applicator of claim 1, which has a circular or oval shape.

11. The applicator of claim 1, wherein the impermeable film comprises a thermoplastic material.

12. The applicator of claim 1, wherein the impermeable film has been treated so as to have anti-slip properties thereon.

13. The applicator of claim 1, wherein the impermeable film has a thickness of 10 $\mu$m and 50 $\mu$m.

14. The applicator of claim 1, wherein the porous material comprises a nonwoven material having a water-absorption capacity of 500% and 2500%.

15. The applicator of claim 1, wherein the porous material is a nonwoven material comprises of a mixture of cellulose (viscose) and polyester fibers.

16. The applicator according to claim 14, wherein the nonwoven material has a unit weight of 20 g/m$^2$ to 80 g/m$^2$.

17. The applicator according to claim 14, wherein the nonwoven material has a unit weight of between and more particularly of 40 g/m$^2$ to 80 g/m$^2$.

18. The applicator of claim 2, wherein the gripping and shading-off zones are separate zones.

19. A process for manufacturing the applicator of claim 1, comprising:

depositing a composition comprising the make-up and having a liquid or pasty consistency onto a flexible sheet comprised of a porous material;

drying the sheet impregnated with the composition; and cutting the sheet around the impregnated zones according to obtain the applicator, so as to form at least one non-impregnated portion at the periphery of the applicator.

20. The process of claim 19, wherein the make-up composition is formed from a dispersion of a binder and at least one type of pigment.

21. The process of claim 19, wherein the binder comprises plaster.

22. A method of applying make-up, comprising holding the applicator of claim 1 and applying the make-up to a body surface.

23. The method of claim 22, wherein the body surface is human skin, eyelashes, or lips.

24. The method of claim 22, wherein the make-up is applied to human skin.

25. A disposable make-up applicator, comprising:

at least one layer comprising a porous, flexible material having a first face and a second face, wherein at least a portion of the first face is impregnated with at least one slakable make-up product, the second face, opposite the first face, is covered with an impermeable film, the first face comprises at least one non-adhesive peripheral portion zone which is not impregnated with the slakable make-up product, and said peripheral portion zone of the applicator forming a gripping zone capable of shading off the make-up product.

26. A disposable make-up applicator, comprising:

at least one layer comprising a porous, flexible material having a first face and a second face, wherein at least a portion of the first face is impregnated with at least one slakable make-up product, the second face, opposite the first face, is covered with an impermeable film, the first face comprises at least one non-adhesive peripheral portion zone which is not impregnated with the slakable make-up product, and the applicator is capable of being gripped by a human user by the peripheral portion zone, said peripheral portion zone being capable of shading off the make-up product.

* * * * *